United States Patent [19]

Teshiba et al.

[11] Patent Number: 4,745,790

[45] Date of Patent: May 24, 1988

[54] ROLLING METHOD AND ROLLING APPARATUS FOR METAL STRIPS

[75] Inventors: Toko Teshiba; Fumiya Yanagishima; Akira Kishida; Hidenori Miyake; Yoshio Nakazato, all of Chiba, Japan

[73] Assignee: Kawasaki Steel Corporation, Kobe, Japan

[21] Appl. No.: 9,602

[22] Filed: Jan. 20, 1987

Related U.S. Application Data

[63] Continuation of Ser. No. 661,698, Oct. 17, 1984, abandoned.

[51] Int. Cl.[4] ..... B21B 1/24; B21B 39/16; B21B 41/10

[52] U.S. Cl. ..... 72/252; 72/21; 72/205; 72/228; 72/247

[58] Field of Search ..... 72/247, 243, 250, 251, 72/252, 21, 228, 205, 234

[56] References Cited

U.S. PATENT DOCUMENTS 2,047,883 7/1936 Phillips ..... 72/243
4,319,473 3/1982 Franke, Jr. et al. ..... 72/247 X

FOREIGN PATENT DOCUMENTS 8112755 9/1981 Fed. Rep. of Germany .
2516409 5/1983 France .
0073403 6/1980 Japan ..... 72/250
353224 7/1931 United Kingdom .
761134 11/1956 United Kingdom .

OTHER PUBLICATIONS

Sorsen, Spencer L., "Basic Techniques for Controlling Web Position", *Automation*, Apr. 1966, vol. 13, #4, pp. 105–110.

Patents Abstracts of Japan, vol. 8, No. 258, Nov. 27, 1984.

Patents Abstracts of Japan, vol. 8, No. 262, Nov. 30, 1984.

Patents Abstracts of Japan, vol. 9, No. 57, Mar. 1985.

*Primary Examiner*—R. L. Spruill
*Assistant Examiner*—Steve Katz
*Attorney, Agent, or Firm*—Balogh, Osann, Kramer, Dvorak, Genova & Traub

[57] ABSTRACT

A method and an apparatus for rolling metal strips by a tandem cold rolling mill. The strip is periodically swung in its width directions at a location upstream of the tandem rolling mill, to bring the strip into contact with rolls of the tandem cold rolling mill over areas of the rolls as widely as possible, thereby preventing irregular wears of the rolls to make it possible to produce defect-free metal strips.

2 Claims, 5 Drawing Sheets

FIG_1 PRIOR ART
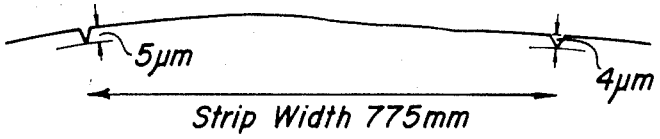
FIG_2 PRIOR ART
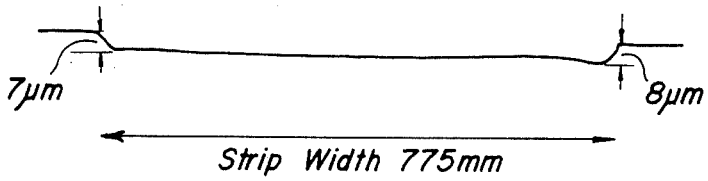
FIG_3a PRIOR ART
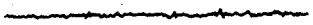
FIG_3b PRIOR ART

ROLLING METHOD AND ROLLING APPARATUS FOR METAL STRIPS

This application is a continuation of application Ser. No. 661,698, filed Oct. 17, 1984, now abandoned.

BACKGROUND OF THE INVENTION

1. Field of the Invention

This invention relates to a rolling method and a rolling apparatus capable of producing defect-free strips in any desired order of strips regardless of their widths to prevent irregular wear of work rolls.

2. Description of the Prior Art

With hitherto used tandem rolling mills, materials to be rolled were usually supplied into a rolling line in the order of the material decreasing their widths from the maximum to the minimum in order to avoid irregular wear on work rolls. Such a rolling effected in the order of the width of materials has been unavoidable.

The term "strip" as used herein is intended to include metal plates, such as mild steel strips, steel plates thicker than usual steel strips, nonferrous metal plates and the like.

This fact will be described in connection with cold rolling with reference to FIGS. 1 and 2 schematically illustrating the wear of work rolls. FIG. 1 shows a profile of a work roll of a No. 4 mill stand which has been used for rolling 300 tons of strips having a width of 775 mm. Local wear occurs apparently in the roll at locations corresponding to edges of the strips. FIG. 2 illustrates similarly a profile of a work roll of a No. 2 mill stand which has been used for rolling 850 tons of strips having a width of 775 mm. Wear occurs susbstantially uniformly over an area corresponding to the width of the strips. Initial roll curves of these work rolls were a sine curve of 2.5/100.

As can be seen from the above illustration, when strips of the same width usually more than 100 tons have been rolled, irregular wear has occurred on the work rolls over full widths of the strips or at the locations corresponding to the edges of the strips. If the work rolls with such irregular wear are used to roll further strips wider than the above strips, the unevenness of the irregular wear are directly transferred onto the wider strips to cause surface defects of the strips, resulting in reduced yield rate of the strips. In order to avoid this, therefore, it is generally obliged to set a rolling schedule in which strips are rolled in the order decreasing the widths from the maximum to the minimum. In contrast herewith, if strips are rolled in an order increasing the widths from narrower to wider strips, it is naturally needed to exchange work rolls to avoid the above defects.

Moreover, if strips thinner than 0.2 mm are rolled after a great amount of strips having the same widths have been rolled, edge defects as shown in FIG. 3*a* and edge cracks as shown in FIG. 4 would occur, even if all the widths of the strips are equal, resulting from the damage of the strip edges caused by local wear already produced as shown in FIG. 1. (FIG. 3*b* illustrates a normal strip edge.) These defects would also decrease marketable values of the products and yield rate, and in extreme cases, result often in breaking down of the strips.

Moreover, there is irregular wear of work rolls other than those above described as shown in FIG. 5 illustrating a profile of the work roll. This irregular wear is probably caused by the fact that extraordinary protrusions longitudinally continuously extending and called "high spots" often occur on the strips in hot rolling (as shown by arrows in FIG. 6), and the extraordinary protrusions would in turn damage work rolls in cold rolling. Such irregular wear causes further defects on strip coils called "built-up" as shown by arrows in FIG. 7. The defects are inadmissible for the strips as marketable products.

SUMMARY OF THE INVENTION

It is a primary object of the invention to provide an improved rolling method and a rolling apparatus for carrying out the method, which eliminates all the disadvantages above described and are capable of rolling strips in the order irrespective of widths of the strips without causing surface defects of the strips.

The invention lies in the discovery as the result of earnest investigation by the inventors, of a method for eliminating the disadvantages of the prior art, that strips are always rolled exclusively at middle portions of the work rolls so as to accelerate the wear at the same locations on the work rolls resulting in the irregular wear.

In order to achieve the above object, according to the invention the method of rolling strips by a tandem rolling mill, provides that the strip is periodically swung in its width directions at a location upstream of the tandem rolling mill.

The tandem rolling mill is preferably a tandem cold rolling mill.

If the tandem cold rolling mill is a completely continuous tandem cold rolling mill, the strip is preferably swung between the rolling mill and a looper upstream thereof.

If the tandem cold rolling mill is a batch type tandem cold rolling mill, the strip is preferably swung between the rolling mill and a pay-off reel upstream thereof, or a pay-off reel itself upstream of the rolling mill is preferably swung relatively to the strip to obtain the same effect as in swinging the strip.

The rolling apparatus including a tandem cold rolling mill for cold rolling strips according to the invention comprises a strip swinging device for periodically swinging the strip in its width directions to bring the strip into contact with rolls of the tandem cold rolling mill over areas of the rolls as widely as possible.

When the tandem cold rolling mill is a completely continuous tandem cold rolling mill, the strip swinging device is preferably arranged between the tandem cold rolling mill and a looper upstream thereof.

When the tandem cold rolling mill is a batch type tandem cold rolling mill, the strip swinging device is preferably arranged between the tandem cold rolling mill and a pay-off reel upstream thereof.

The invention will be more fully understood by referring to the following detailed specification and claims taken in connection with the appended drawings.

BRIEF DESCRIPTION OF THE DRAWINGS

FIG. 1 illustrates a profile of a roll showing local wear caused by edges of strips;

FIG. 2 illustrates a profile of a roll showing a uniform wear over an entire area corresponding to a strip width;

FIG. 3*a* shows a profile of edge defects;

FIG. 3*b* shows a normal strip edge;

DETAILED DESCRIPTION OF THE PREFERRED EMBODIMENT

Figure 4:
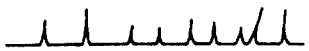
FIG. 4 PRIOR ART
FIG. 4 illustrates edge cracks of a strip.
Figure 5:
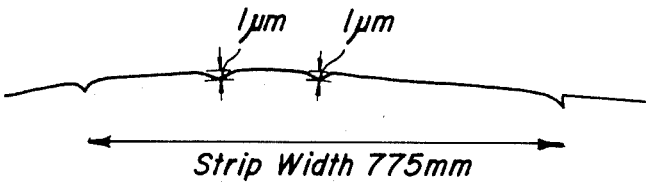
FIG. 5 PRIOR ART
FIG. 5 shows a profile illustrating irregular wear on a roll due to high spots.
Figure 6:
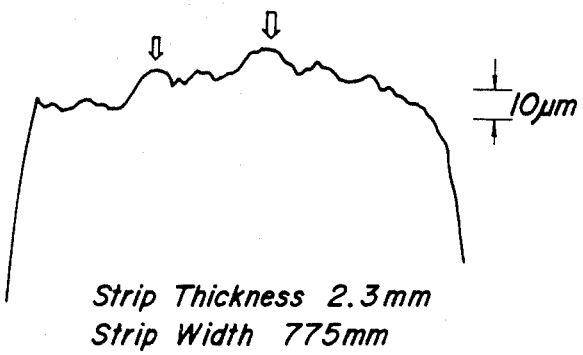
FIG. 6 PRIOR ART
FIG. 6 illustrates examples of high spots.
Figure 7:
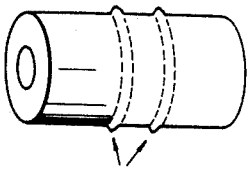
FIG. 7 PRIOR ART
FIG. 7 shows defects such as built-up on a strip coil.
Figure 8:
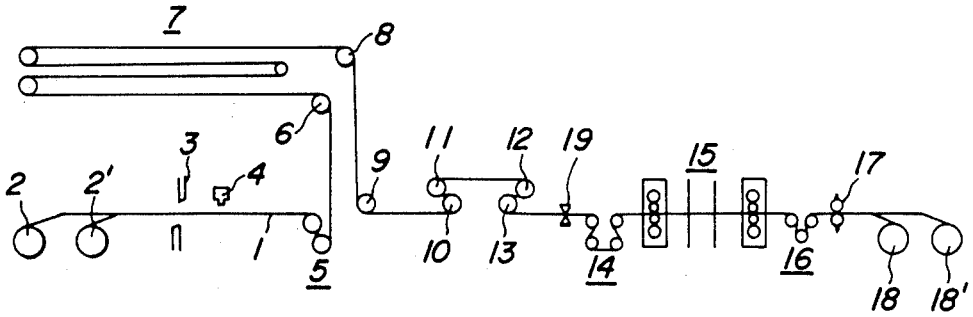
FIG. 8 schematically illustrates a rolling line of a completely continuous tandem cold rolling mill to which the present invention is applied.

FIG. 8 schematically illustrates a rolling line of a completely continuous tandem cold strip mill to which the present invention is applied. As shown in FIG. 8 there are provided in series upstream of the tandem cold strip mill 15, pay-off reels 2 and 2', a shearing machine 3, a welder 4, tension bridle rolls 5, a deflector roll 6, a looper 7, deflector rolls 8, 9 and 10, a strip swinging device 11, deflector rolls 12 and 13, a strip displacement measuring device 19 and tension bridle rolls 14. Downstream of the cold strip mill 15, there are in series tension bridle rolls 16, a rotary shear 17 and tension reels 18 and 18'.

The terms "upstream" and "downstream" used herein are to be understood to mean the side on which strips are supplied to the rolling mill and the side on which the rolled strips exit the rolling mill, respectively.

The strip swinging device 11 may be of any construction capable of displacing a strip in its width directions or lateral or traverse directions, such as a steering roll, generally used as centering means, which is adapted to be tilted relatively to an axis of a rolling line to shift a strip in its width directions.

In such a rolling installation, strips unwound from the pay-off reels 2 and 2' are fed to the shearing machine 3 where leading and trailing ends are cut. The welder 4 welds the preceding and trailing strips to form an integral strip 1. The strip 1 is then fed through the tension bridle rolls 5, the deflector roll 6, the looper 7, the deflectors 8, 9 and 10 to the strip swinging device 11 which slowly and periodically swing the strip in its width directions. After passing through the tension bridle rolls 14, the strip is cold rolled by the tandem cold strip mill 15. The rolled strip is cut into predetermined sizes by the rotary shear 16 and then the strips of the predetermined lengths are wound around the tension reels 18 and 18'. In winding the strips around the tension reels, it is preferable to align edges of the strips snugly by means of an edge position controller (EPC) or the like in order to obtain sightly appearance of coils of the strips, to facilitate handling of the coils and to prevent the coils from being scratched.

Figure 9:
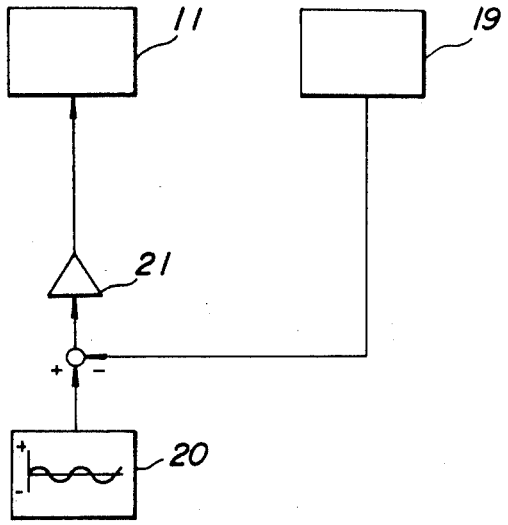
FIG. 9 shows a control system for periodically swinging strips in their width directions.

FIG. 9 illustrates one example of a control system for periodically swinging the strip in its width directions by the above strip swinging device. This control system comprises a strip swinging device 11, a strip displacement measuring device 19, a function generator 20 and an amplifier 21.

Signals from the function generator 20 are amplified by the amplifier 21 to control a driving device (not shown) for the strip swinging device 11 so as to swing a strip in its width directions. In case of a strip swinging device used similar to the steering roll, a flow control valve, a change-over valve or the like for supplying high pressure oil to hydraulic cylinders may be controlled. Moreover, the displacements of the strip in the width directions are measured by the strip displacement of the strip in the width directions are measured by the strip displacement measuring device 19, whose measured result is fed back to the function generator 20 to maintain a predetermined amplitude of the swing of the strip. In this case, moreover, it is of course necessary to provide in the strip displacement measuring device 19 a circuit for compensating difference in position between the strip swinging device 11 and the strip displacement measuring device 19.

Figure 10:
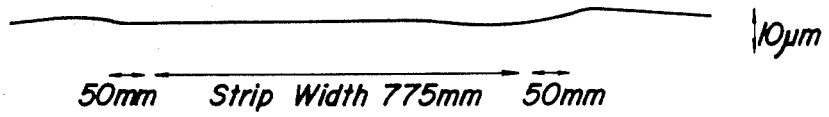
FIG. 10 illustrates surface wear of a profile of a work roll used for rolling strips according to the invention.

FIG. 10 illustrates a profile of a work roll which has been worn by rolling 150 tons of strips having a width of 775 mm being swung with an amplitude of 50 mm on 5 min/cycle. It is clearly evident that the roll has been worn lengthwise smoothly. In this experimental operation, edges of the rolled strips were in high quality, and immediately thereafter, strips wider than 775 mm could be continuously rolled.

Figure 11:
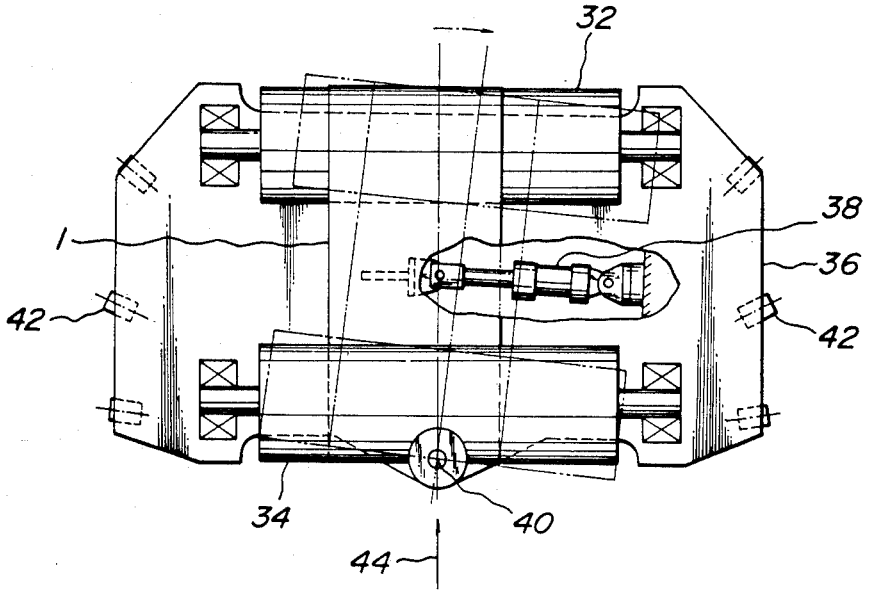
FIG. 11 is a front elevation illustrating one example of a swinging device used in the ivnention.

FIG. 11 illustrates one example of a swinging device used in the present invention.

Figure 12:
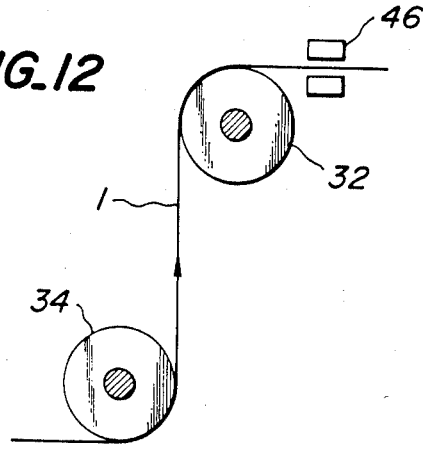
FIG. 12 is a schematic side view of the steering rolls as shown in FIG. 11.

FIG. 12 illustrates a side view of the steering rolls as shown in FIG. 11.

As shown in FIGS. 11 and 12, the swinging device 30 for strips comprises two steering rolls 32 and 34 rotatably journalled by bearings on a framework 36 and a hydraulic piston and cylinder assembly 38 whose cylinder head is pivotally connected to a stationary member and whose piston rod end is pivotally connected to the framework 36, so that when a piston rod is extended and retracted, the steering rolls can be swung about a pivotal point 40 of the framework as shown by solid and phantom lines together with the framework supported by rollers 42. In FIG. 11, a part of the framework 36 is removed to illustrate the piston and cylinder assembly 38 behind the framework.

When the strip 1 is tilted during moving in a direction shown by an arrow 44, the inclination is detected by sensors 46 for monitoring edges of the strip 1. According to the tilted amount of the strip 1, the framework 36 and hence the steering rolls 32 and 34 are swung in a vertical plane by means of the piston and cylinder assembly. If the framework 36 is rotated in a clockwise direction viewed in FIG. 11, the movement of the strip 1 is corrected to the right on the exit side of the steering roll 32.

Although the invention applied to the completely continuous tandem cold strip mill has been explained, the invention is of course applicable to a batch type tandem cold strip mill. In this case, the strip swinging device as above described is of course arranged upstream of the strip mill. However, the same effect can be accomplished by swinging a strip in its width directions by an action of a pay-off reel itself.

Even with a completely continuous strip mill, it is possible to employ a pay-off reel capable of swing a strip as in the batch type. However, the swinging of the strip by the pay-off reel itself may cause a meandering or serpentine motion of the strip when passing through the looper.

Furthermore, it is conceivable to swing the work rolls themselves in width directions of a strip (so-called "work roll shifting system") without swinging the strip.

However, it is not effective in view of the cost of installation and maintenance.

This invention is moreover applicable not only to the cold strip mill but also hot strip mill and further to the lines producing strips or thicker steel plates directly fed from the continuous casting shops and to lines producing nonferrous plates.

As can be seen from the above explanation, in addition to the production of surface defect-free strips, the invention is advantageous in the following points.

(1) A procedure of rolling can be set without considering widths of strips to be rolled.

(2) Accordingly, strips can be rolled in the order of thickness of the strips from thickest to thinnest, so that changes in gap between work rolls through which strips are rolled are decreased, with the result that possible deviation of thicknesses of the strips from predetermined values is reduced.

(3) Defects at edges and built-up of strip are eliminated particularly in rolling the strips thinner than 0.2 mm.

(4) The initial unit price of rolls is reduced.

(5) The productivity in rolling is improved.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A method of rolling strips of metal in a tandem rolling mill with minimum irregular wear of work rolls and minimum work order width scheduling, said method comprising the steps of:

periodically swinging the metal strip, as it is moving along the rolling plane, in its width directions with a constant amplitude in accordance with output signals from a function generator, and at a location upstream of the tandem rolling mill, and subjecting the metal strip to rolling operation by said tandem rolling mill, where the rolling mill is a completely continuous tandem cold rolling mill having a looper upstream thereof, and wherein said step of swinging the metal strip occurs between the looper and the rolling mill.

2. A continuous tandem rolling apparatus for cold rolling metal strips which minimizes irregular wear of work rolls, and the need for strip width work order scheduling, said apparatus comprising:

a looper upstream of a tandem rolling mill;

strip swinging means disposed on the entry side of said rolling mill between the looper and the tandem rolling mill for reciprocating the strip, as it is moving along a rolling plane, in its width direction at a constant amplitude, and control means for actuating said strip swinging means while the strip is passing through the rolling mill.

* * * * *